US007207866B2

(12) United States Patent
Allaire et al.

(10) Patent No.: US 7,207,866 B2
(45) Date of Patent: Apr. 24, 2007

(54) PRESSURE FEED GRINDING OF AMLCD SUBSTRATE EDGES

(75) Inventors: Roger A. Allaire, Big Flats, NY (US); James W. Brown, Painted Post, NY (US); Toshihiko Ono, Shizuoka (JP); Babak R. Raj, Elmira, NY (US); Masayuki Shinkai, Shizuoka (JP)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 11/333,730

(22) Filed: Jan. 17, 2006

(65) Prior Publication Data

US 2006/0121832 A1 Jun. 8, 2006

(51) Int. Cl.
*B24B 1/00* (2006.01)

(52) U.S. Cl. ..... 451/41; 451/44

(58) Field of Classification Search ..... 451/11, 451/24, 44, 41, 64, 178, 174, 139, 236, 280, 451/138

See application file for complete search history.

(56) References Cited

U.S. PATENT DOCUMENTS

| | | | | |
|---|---|---|---|---|
| 1,493,787 | A * | 5/1924 | Little et al. | 451/236 |
| 4,107,880 | A * | 8/1978 | Randall | 451/236 |
| 4,493,166 | A | 1/1985 | Lange et al. | |
| 4,575,970 | A | 3/1986 | Kozai et al. | |
| 4,667,443 | A | 5/1987 | Sakurai et al. | |
| 4,756,124 | A * | 7/1988 | Rossi et al. | 451/44 |
| 5,143,196 | A | 9/1992 | Henn et al. | |
| 5,146,715 | A | 9/1992 | Bando | |
| 5,148,632 | A | 9/1992 | Adler et al. | |
| 5,423,717 | A | 6/1995 | Boaz | |
| 5,514,025 | A | 5/1996 | Hasegawa et al. | |
| 5,655,956 | A | 8/1997 | Ferreira et al. | |
| 6,099,385 | A | 8/2000 | Stock | |
| 6,196,902 | B1 | 3/2001 | Gazca-Ortiz et al. | |
| 6,216,491 | B1 | 4/2001 | Fehlner | |
| 6,325,704 | B1 | 12/2001 | Brown et al. | |
| 6,409,580 | B1 | 6/2002 | Lougher et al. | |
| 6,428,390 | B1 | 8/2002 | Clark et al. | |
| 6,755,724 | B2 | 6/2004 | Shin et al. | |
| 6,769,969 | B1 | 8/2004 | Duescher | |

FOREIGN PATENT DOCUMENTS

| | | |
|---|---|---|
| EP | 0 601 748 A1 | 11/1993 |
| EP | 0 601 748 B1 | 11/1993 |

* cited by examiner

*Primary Examiner*—Hadi Shakeri
(74) *Attorney, Agent, or Firm*—Christopher Nicastri; Adenike Adebiyi

(57) ABSTRACT

The present invention is directed to an apparatus for grinding or polishing at least one edge of a glass substrate. The apparatus includes an air bearing support member configured to pivot about an axis of rotation with zero frictional resistance opposing said pivotal movement. A grinding unit is coupled to the air bearing support member. The grinding unit is configured to apply a predetermined force normal to the at least one edge to remove a predetermined amount of material from the at least one edge. The predetermined force is directly proportional to the predetermined amount of material and less than a normal force resulting in glass substrate breakage.

9 Claims, 4 Drawing Sheets

PRESSURE FEED GRINDING OF AMLCD SUBSTRATE EDGES

BACKGROUND OF THE INVENTION

1. Field of the Invention

The present invention relates generally to display glass substrates, and particularly to a system for edge finishing glass substrates.

2. Technical Background

The manufacturing process of flat panel display substrates requires specific sized glass substrates capable of being processed in standard production equipment. To obtain substrates having the proper size, mechanical scoring and breaking processes, or a laser scoring techniques are employed. Each of these sizing methods requires edge finishing. The finishing process involves grinding and/or polishing the edges to remove sharp edges and other defects that may degrade the strength and durability of the substrate. Furthermore, there are many processing steps that require handling in the manufacturing of an LCD panel. Thus, glass substrates used for Liquid Crystal Displays (LCD) require an edge that is sufficiently durable for mechanical contact.

The finished edges are created by grinding the unfinished edge with an abrasive metal grinding wheel. In conventional systems, the glass substrate is disposed on a chuck and advanced through a series of grinding positions. Each position is equipped with a different abrasive grinding wheel based on the coarseness/fineness of the grit disposed on the wheel. The finishing process is complete after the glass substrate traverses each grinding position. However, when the glass is not properly aligned relative to the grinding wheel, the quality of the finished glass substrate is degraded. In particular, glass misalignment can adversely impact the dimensional accuracy of the glass. Second, glass misalignment may cause inferior edge quality, which usually results in a substrate of inferior strength. Accordingly, substrate breakage may occur during LCD processing steps. Further exacerbating the problems discussed above, is the demand for larger and larger display sizes. This demand, and the benefits derived from economies of scale, are driving AMLCD manufacturers to process larger display substrates. It is therefore critical that larger display substrates are provided having the requisite edge quality, dimensional accuracy, and strength.

There are three approaches that are being considered to address the above stated issues. In one approach, substrate manufacturers are evaluating grinding systems that offer improved alignment accuracy. Unfortunately, since LCD manufacturers are using larger and larger substrates, alignment tolerances become much more critical when the size of the substrate increases. Accurate alignment is more of a necessity because small skew angles translate into larger errors when larger substrates are being processed. One drawback to this approach relates to the fact that while alignment tools may be acquired having the requisite precision, the accuracy cannot be maintained over time due to wear.

In another approach that has been considered, grinding systems may be employed that compensate for lack of alignment accuracy by removing more material. Typically, edge finishing grinding systems need only remove approximately 100 microns of material. The concept is to provide a larger substrate and remove the right amount of material to meet dimensional requirements. One way to accomplish this is to use a system that includes multiple grinding steps. This translates into more grinding spindles and more grinding wheels. One drawback to this approach is the capital expense of the additional processing equipment. Further, once the equipment is obtained, more equipment requires more maintenance. Another way to remove more material is to employ coarser grinding wheels. Unfortunately, this option is not attractive because a rougher finish has a greater propensity for substrate breakage. Yet another way to remove more material is to reduce the speed at which substrates traverse the finishing system. Unfortunately, this approach reduces production capacity and the ground edge quality. Further, increased capital expenditures would be required if the production volume is to be maintained.

In yet another approach that has been considered, a self-aligning grinding system may be used that tracks the substrate edge. The pressure feed grinding approach applies a predetermined force normal to the edge of the substrate. The grinding wheel moves, or tracks, with the instantaneous position of the edge by rotating about a pivot element. Because grinding wheel position is determined by the position of the substrate edge, the resultant substrate product has improved dimensional accuracy, relative to conventionally ground substrates. Unfortunately, there is a drawback to this technique as well. The cylindrical pivot employed in conventional pressure feed systems includes mechanical bearings. In order to overcome the frictional force of these mechanical bearings, a normal force of approximately 16 N must be applied. This force exceeds the strength of the glass substrate and breakage will occur if that force is applied. While the pressure feed grinding approach appears to be promising, it cannot be employed unless the aforementioned problems are overcome.

In light of the foregoing, it is desirable to provide an edge finishing apparatus that is configured to remove a precise amount of glass and yet maintain the edge quality. It is also desirable to provide an edge finishing apparatus having improved dimensional accuracy. Furthermore, the edge finishing apparatus should finish the edge of a glass in a timely manner without degrading the desired strength and edge quality attributes of the glass. What is needed is a pressure feed grinding apparatus that provides the above described features while overcoming the limitations of conventional pressure feed grinding systems discussed above.

SUMMARY OF THE INVENTION

The present invention addresses the needs described above. The pressure feed grinding apparatus of the present invention provides a frictionless system that overcomes the limitations of conventional pressure feed grinding systems. The present invention provides an edge finishing apparatus that is configured to remove a precise amount of glass. As such, the dimensional accuracy of glass substrates finished by the present invention is much improved relative to glass substrates finished by conventional systems. Further, the present invention provides finished glass substrates that have superior strength and edge quality.

One aspect of the present invention is an apparatus for grinding or polishing at least one edge of a glass substrate. The apparatus includes an air bearing support member configured to pivot about an axis of rotation with zero frictional resistance opposing said pivotal movement. A grinding unit is coupled to the air bearing support member. The grinding unit is configured to apply a predetermined force normal to the at least one edge to remove a predetermined amount of material from the at least one edge. The predetermined force is directly proportional to the predetermined amount of material and less than a normal force resulting in glass substrate breakage.

In another aspect, the present invention includes a method for grinding or polishing at least one edge of a glass substrate. The method includes providing an air bearing support member configured to pivot about an axis of rotation with zero frictional resistance opposing the pivotal movement. A grinding wheel is coupled to the air bearing support member, such that the grinding wheel tends to pivot about the axis of rotation. The grinding wheel is positioned at a corner of the glass substrate. The grinding wheel is in contact with the at least one edge. The grinding wheel is loaded to thereby apply a predetermined force normal to the at least one edge. The predetermined force is directly proportional to the predetermined amount and less than a normal force resulting in glass substrate breakage. The glass substrate is moved in a tangential direction relative to the grinding wheel to remove a predetermined amount of material from the at least one edge.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
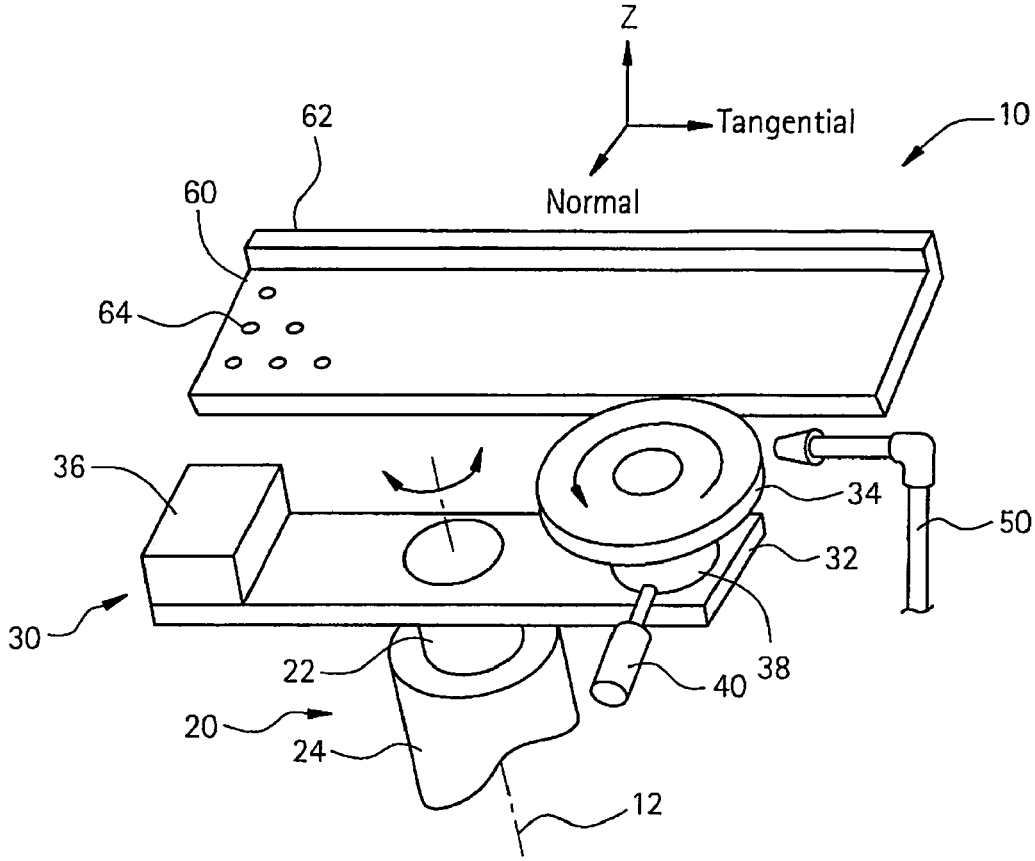
FIG. 1 is a perspective view of the pressure feed grinding system in accordance with the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the apparatus of the present invention is shown in FIG. 1, and is designated generally throughout by reference numeral 10.

In accordance with the invention, the present invention is directed to an apparatus for grinding or polishing at least one edge of a glass substrate. The apparatus includes an air bearing support member configured to pivot about an axis of rotation with zero frictional resistance opposing said pivotal movement. A grinding unit is coupled to the air bearing support member. The grinding unit is configured to apply a predetermined force normal to the at least one edge to remove a predetermined amount of material from the at least one edge. The predetermined force is directly proportional to the predetermined amount of material and less than a normal force resulting in glass substrate breakage. Thus, the pressure feed grinding apparatus of the present invention overcomes the limitations of conventional pressure feed grinding systems. The present invention provides an edge finishing apparatus that is configured to remove a precise amount of glass. As such, the dimensional accuracy of glass substrates finished by the present invention is much improved relative to glass substrates finished by conventional systems. Further, the present invention provides finished glass substrates that have superior strength and edge quality.

As embodied herein, and depicted in FIG. 1, a perspective view of the pressure feed grinding system 10 in accordance with the present invention is disclosed. System 10 includes air bearing support structure 20 coupled to grinding unit 30. Air bearing support structure 20 includes air bearing cylinder 22 disposed within stationary housing 24. Air bearing cylinder 22 is coupled to support platform 32. As shown, support platform 32 tends to pivot about the longitudinal axis 12 of cylinder 22. Thus, the longitudinal axis 12 of cylinder 22 functions as an axis of rotation for grinding unit 30. Air bearing motor 38 is disposed on one end of support member 32. Motor 38 is configured to drive grinding wheel 34. Pneumatic cylinder 40 is coupled to motor 38 and is configured to apply a predetermined force in a direction that is normal to the edge of a glass substrate being finished by system 10. Counter-weight 36 is disposed on the end of support 32 that is opposite motor 38 and grinding wheel 34. Those of ordinary skill in the art will recognize that counter-weight 36 provides grinding unit 30 with balance in the z-direction. Conveyor vacuum chuck 60 is disposed proximate grinding wheel 34. Vacuum chuck 60 includes a raised edge 62 that is used to register the glass substrate. Vacuum chuck 60 includes a plurality of holes which are in communication with a vacuum source. Because the grinding/polishing operations generate heat, system 10 also provides coolant nozzle 50 at the location where grinding wheel 34 interfaces vacuum chuck 60 and the glass substrate.

Air bearing support structure 20 may be of any suitable type, as long as there is zero frictional resistance opposing the pivotal movement about axis 12. In one embodiment, air bearing support structure 20 is of a type manufactured by New Way Machine Components, Inc. In the present invention, air bearing cylinder 22 is supported by a thin film of pressurized air that provides a zero friction load bearing interface between surfaces that would otherwise be in contact with each other. The thin film air bearing is generated by supplying a flow of air through the bearing itself to the bearing surface. Unlike traditional 'orifice' air bearings, the air bearing of the present invention delivers air through a porous medium to ensure uniform pressure across the entire bearing area. Although the air constantly dissipates from the bearing site, the continual flow of pressurized air through the bearing is sufficient to support the working loads.

The use of a pressure feed grinding system is made possible by the zero static friction air bearing. As discussed above in the background section, a normal force of approximately 16 N must be applied to overcome the frictional force of conventional mechanical bearings. This force exceeds the strength of the glass substrate. Because of zero static friction, infinite resolution and very high repeatability are possible. For example, because the normal force applied to grinding wheel 34 does not have to overcome any frictional force, the applied normal force is substantially proportional to the amount of material that is removed (chuck speed being constant). The inventors of the present invention have determined that under typical system settings, every 1 N applied translates to 25 microns of material removed. The normal force applied to the edge is typically within the range between 1 N–6 N. This translates to the removal of an amount of material in a range between 25–150 microns. In a typical application, a 4 N force is applied, resulting in the removal of approximately 100 microns of material. Thus, the zero friction air bearing support 20 of the present invention offers distinct advantages in dimensional accuracy and precision positioning. There are other features and benefits associated with zero static friction air bearings.

Because a zero static friction air bearing is also a non-contact bearing, there is virtually zero wear. This results in consistent machine performance and low particle generation. Further, non-contact air bearings avoid the conventional bearing-related problem of lubricant handling. Simply put, air bearings do not use oil lubrication. Accordingly, the problems associated with oil are eliminated. In dusty environments (dry machining) air bearings are self-cleaning because the aforementioned positive air pressure generated by the air flow removes any ambient dust particles. In contrast, conventional oil-lubricated bearings are compromised when the ambient dust mixes with the lubricant to become a lapping slurry.

Figure 2:
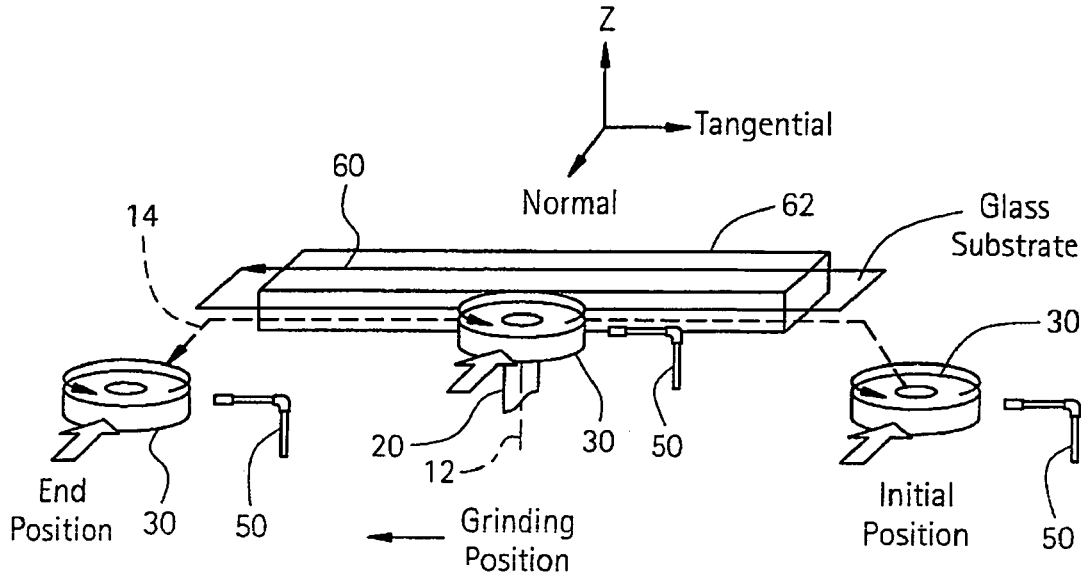
FIG. 2 shows the pressure feed grinding system depicted in FIG. 1 in operation.

Referring to FIG. 2, the pressure feed grinding system 10 is shown in operation. First, the glass substrate is placed on vacuum conveyor 60 in registration with raised edge 62. A vacuum is applied to hold the glass substrate in place during the edge finishing operation. In this example, the size of the glass sheet is approximately 457 mm×76 mm×0.7 mm. The angular velocity of the grinding wheel is substantially equal to 5,000 rpm. Grinding wheel 34 is disposed at the leading edge of the substrate at the initial position, and a normal force of 4 N is applied by pneumatic cylinder 40 (not shown). The glass substrate is linearly advanced in the tangential direction by vacuum chuck 60 at a rate of approximately 5 meters/minute. At the conclusion of the grinding/polishing operation, when grinding wheel 34 passes the trailing edge of the glass substrate, the 4 N normal force is relaxed and grinding wheel 34 is removed from the edge of the substrate. Approximately 100 microns of material has been uniformly removed from the edge along the entire length of the substrate. It is noted that FIG. 2 is not to scale, the maximum distance that air bearing support 20 can move when moving from the initial position to the grinding position, or from the grinding position to the end position, is approximately 1 mm.

FIGS. 3A–4B are examples illustrating the edge tracking capabilities of the present invention. Edge tracking refers to the position of grinding wheel 30 relative to the glass substrate as it moves from the leading edge to the trailing edge. The ability to track the edge is one of the advantages of a pressure feed system. This feature obviates the alignment issues present in conventional systems. Because air bearing spindle 20 is frictionless, it allows grinding unit 30 to track the edge of the substrate in spite of a skewed substrate. FIGS. 3A–4B represent experiments performed to verify the edge tracking capabilities of the present invention.

Figure 3A:
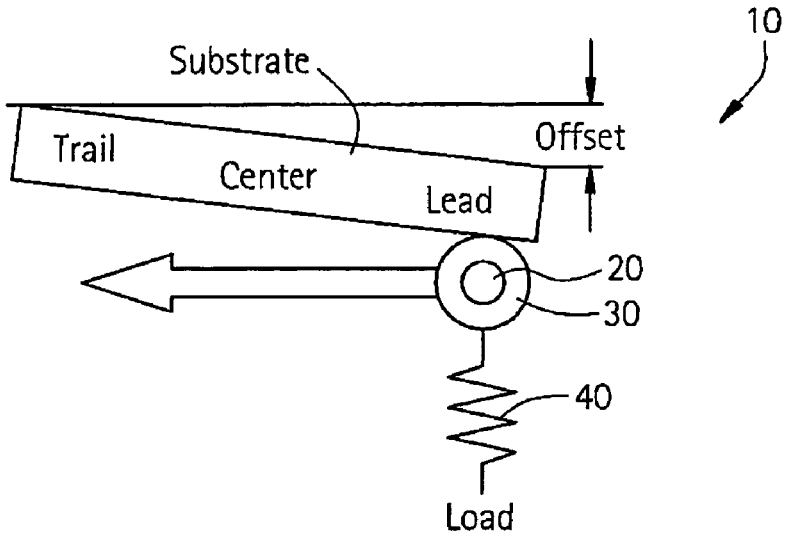
FIG. 3A is a schematic of the pressure feed grinding system in plan view showing a glass substrate having a skewed leading edge.
Figure 3B:
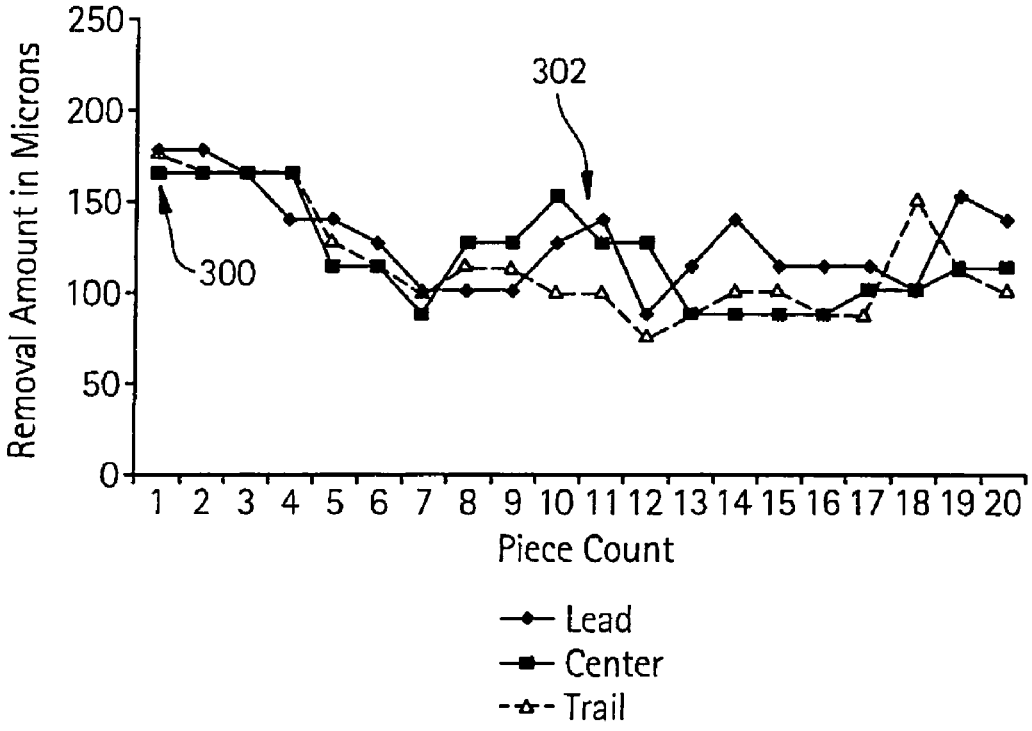
FIG. 3B is a chart showing the edge tracking performance of the arrangement depicted in FIG. 3A.

Referring to FIG. 3A, a schematic of system 10 in plan view shows a glass substrate having a skewed leading edge. In this example, load cylinder 40 applies a 3.5 N force normal to the substrate edge. The glass substrate is skewed by offsetting the leading edge by 300 microns. FIG. 3B is a chart showing the edge tracking performance of the arrangement depicted in FIG. 3A. FIG. 3B plots the performance of system 10 for twenty substrate pieces. Referring to data points 300, which represents the first substrate processed, system 10 removes substantially the same amount of material from both the leading edge and the trailing edge. System 10 removes approximately 10 microns less from the center portion of the substrate. While there are some deviations (See data points 302), system 10 tracks the edge of the substrate remarkably well. It is noted that the amount of material removed decreases after repeated uses. This most likely due to the wear on grinding wheel 34.

Figure 4A:
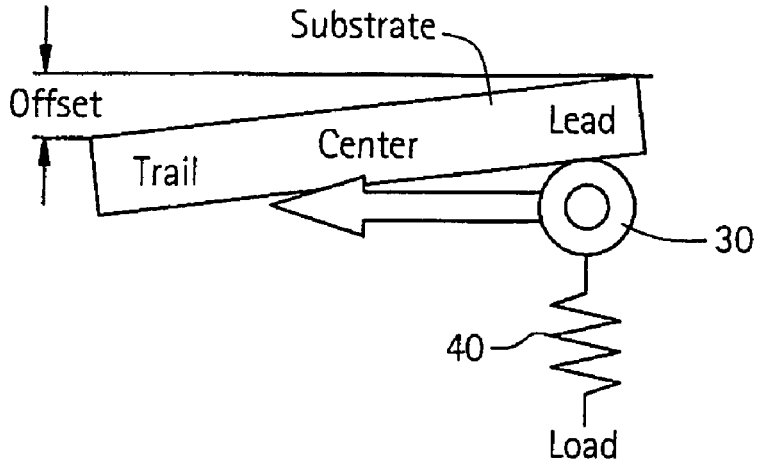
FIG. 4A is a schematic of the pressure feed grinding system in plan view showing a glass substrate having a skewed trailing edge.
Figure 4B:
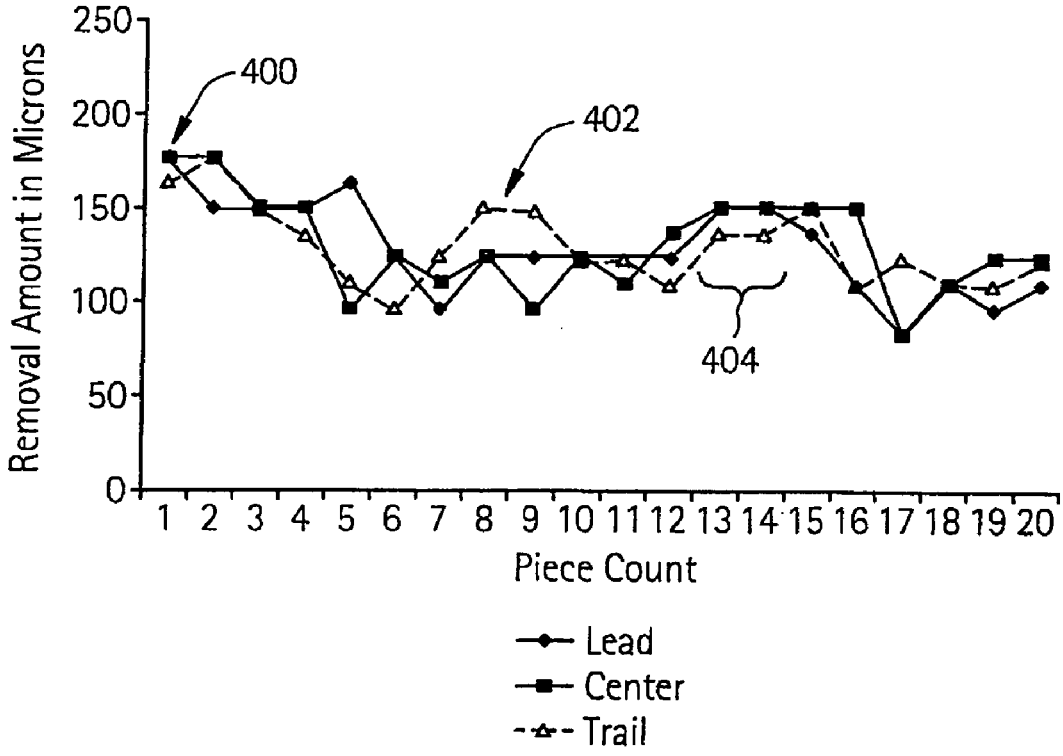
FIG. 4B is a chart showing the edge tracking performance of the arrangement depicted in FIG. 4A.

FIG. 4A is also a schematic of system 10 in plan view. This diagram shows a glass substrate having a skewed trailing edge. However, in this experiment the glass substrate is skewed by offsetting the trailing edge by 300 microns. Again, load cylinder 40 applies a 3.5 N force normal to the substrate edge. FIG. 4B is a chart showing the edge tracking performance of the arrangement depicted in FIG. 4A. FIG. 4B plots the performance of system 10 for twenty substrate pieces. Referring to data points 400, which represents the first substrate processed, system 10 removes substantially the same amount of material from both the leading edge and the center edge portion. System 10 removes approximately 10 microns less from the trailing edge of the substrate. Referring to data points 402, there are some tracking deviations present. However, as evidenced by data points 404, the difference in the amount of material removed from the various edges of the substrate is typically in the 10–15 micron range. The applied force is not the only factor at determining the amount of glass removal achieved during grinding. The condition of the wheel surface also has a significant impact on the amount of material that is removed. Referring to FIG. 3B and FIG. 4B, the effective life span of grinding wheel 34 is a factor in the removal rate of edge grinding system 10.

The standard grinding procedure used in conventional systems facilities is to dress the grinding wheel and grind to a fixed position to thereby ensure that the targeted size is met. During this process, the normal load will increase to a point that will require the wheel to be redressed to allow for further grinding. If the wheel is not dressed at a reasonable load, the grinding wheel will create defects in the glass. Typically, these defects are chipping and burning defects. These defects occur when the diamond particles in the wheel are not sufficiently sharp enough to remove the desired amount of material. On the other hand, one advantage of the present invention is that chipping and burning defects will not occur when using pressure feed type of grinding because, as explained above, the set normal force is always lower than the amount of force required to create these defects. The concern with pressure feed grinding is that as the wheel ages the removal rate diminishes to a point where an insufficient amount of material is removed.

Figure 5:
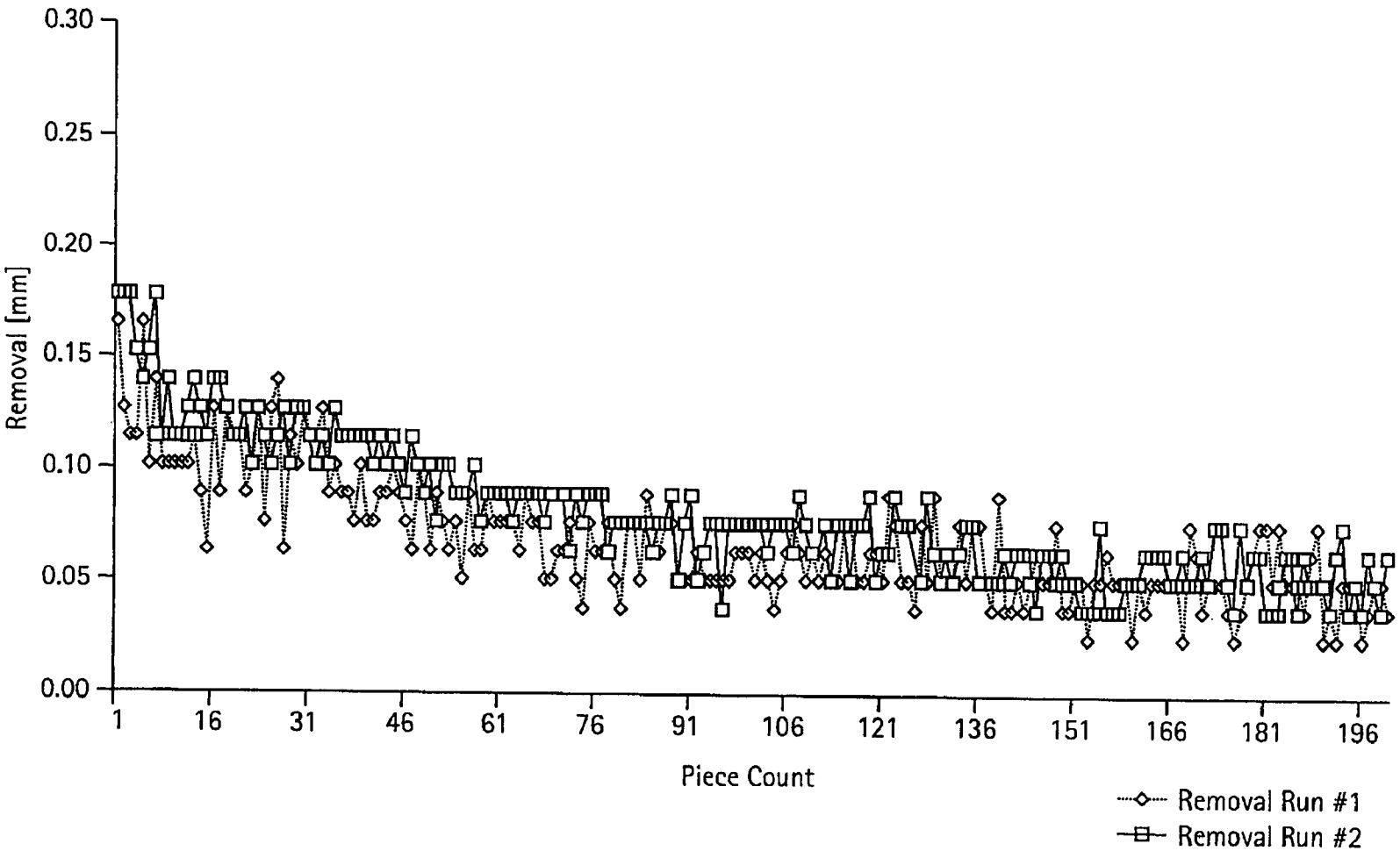
FIG. 5 is a chart showing the effects of wheel aging on material removal.

Referring to FIG. 5, a chart showing the effects of wheel aging on material removal is disclosed. In this experiment, a 3.5 N force is applied to the substrate edge. Each starting point was begun with a freshly stick dressed wheel. Subsequently, almost 200 substrates were finished. Initially, system 10 removes, on average, about 150 microns of material. At the end of the run, the amount of material removed is in the 50 micron range. Experimental testing was conducted using a 150 diameter 600 grit wheel to determine if any differences or advantages could be achieved using a finer diamond mesh relative to conventional production capabilities.

Experiments have also shown that as the wheel ages, the friction of the wheel mesh decreases, resulting in a decrease in the tangential force component. Thus, as might be expected, the applied normal load should be increased during the course of the run to compensate for the decreased friction (tangential load).

Grit size may also play a factor in the surface roughness as the wheel ages. There is a slight improvement in the edges produced by the present invention using a 450 grit wheel relative the edge roughness of substrates finished using conventional systems. There was a significant improvement seen when using a 600 grit wheel with the present invention. When the 450 grit wheels are used, roughness decreases as the number of units produced increases. Initially, surface roughness is in a range between 0.7–0.9 microns. At the end of the run (piece count=200), the roughness is in the 0.5–0.6 micron range. When a 600 grit wheel is employed in system 10, the surface roughness remains relatively stable (0.4–0.6 microns).

It is also noted that 600 grit wheels result in superior interfaces relative to 450 grit wheels. The interface is the location where the ground edge meets the major surface of the substrate. 600 grit wheels provide smoother interfaces. A smoother interface improves a substrate's structural integrity and results in a stronger substrate. Thus, the substrate having a smoother interface is more likely to avoid breakage during subsequent processing steps.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A method for grinding or polishing at least one edge of a glass substrate, the method comprising:

coupling an air bearing support member configured to pivot about an axis of rotation with substantially zero frictional resistance opposing said pivotal movement to a support platform including a counter weight;

coupling a grinding unit comprising a grinding wheel and a drive motor to the support platform symmetric to said counter weight about the axis of rotation such that the grinding unit pivots about the axis of rotation and the axis of rotation is offset from a rotational axis of the grinding wheel;

positioning the grinding wheel at a comer of the glass substrate, the grinding wheel being in contact with at least one edge of the glass substrate;

applying a load to the grinding unit to thereby directly apply a predetermined force normal to the at least one edge, the predetermined force being directly proportional to a predetermined amount and less than a normal force resulting in glass substrate breakage; and linearly advancing the glass substrate in a tangential direction relative to the grinding wheel while rotating the grinding wheel to remove the predetermined amount of material from the at least one edge.

2. The method of claim 1, wherein the predetermined force causes the grinding wheel to track the at least one edge.

3. The method of claim 1, wherein the predetermined force is substantially within the range of 1 N–6 N, and the predetermined amount is substantially within the range of 25 microns–150 microns.

4. The method of claim 3, wherein the predetermined force is substantially equal to 4 N and the predetermined amount of material removed from the edge is substantially equal to 100 microns.

5. The method of claim 1, wherein a thickness of the predetermined amount of material removed from the at least one edge is uniform.

6. The method of claim 1, wherein the step of linearly advancing further comprises the step of rotating the grinding wheel at a predetermined angular velocity.

7. The method of claim 6, wherein the predetermined angular velocity is approximately 5000 rpm.

8. The method of claim 1, wherein the step of linearly advancing further comprises the step of moving the glass substrate in a tangential direction relative to the grinding wheel at a predetermined linear velocity.

9. The method of claim 8, wherein the predetermined linear velocity is approximately 5 meters/minute.

* * * * *